US007430297B2

(12) United States Patent
Akino

(10) Patent No.: US 7,430,297 B2
(45) Date of Patent: Sep. 30, 2008

(54) MOVING RIBBON MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 506 days.

(21) Appl. No.: 11/067,929

(22) Filed: Mar. 1, 2005

(65) Prior Publication Data

US 2005/0196000 A1 Sep. 8, 2005

(30) Foreign Application Priority Data

Mar. 2, 2004 (JP) ..... 2004-057397

(51) Int. Cl.
*H04R 25/00* (2006.01)

(52) U.S. Cl. ..... 381/176; 381/399; 381/426

(58) Field of Classification Search ..... 381/174–176, 381/369, 399, 408, 423, 426, 427, 431, 191; 367/140, 181, 170; 29/25.41, 25.42
See application file for complete search history.

(56) References Cited

U.S. PATENT DOCUMENTS 3,564,163 A * 2/1971 Hobrough ..... 381/399
4,473,723 A * 9/1984 Hobrough ..... 381/399
5,062,140 A * 10/1991 Inanaga et al. ..... 381/399
7,136,496 B2 * 11/2006 van Halteren et al. ..... 381/174

* cited by examiner

*Primary Examiner*—Huyen D Le
(74) *Attorney, Agent, or Firm*—Manabu Kanesaka

(57) ABSTRACT

A ribbon microphone includes a diaphragm made of an aluminum foil. To provide a corrosion resistance and a favorable electrical connection in the junction between the aluminum foil and backplates for a long time, a gold deposited film is formed on opposite surfaces of the diaphragm. Preferably, a gold deposited film is also formed on the inner surfaces of electrode plates attached to each end of the diaphragm.

1 Claim, 1 Drawing Sheet

MOVING RIBBON MICROPHONE

RELTED APPLICATIONS

The present application is based on, and claims priority from, Japan Application Number 2004-057397, filed Mar. 2, 2004, the disclosure of which is hereby incorporated by reference herein in its entirety.

TECHNICAL FIELD

The present invention relates to a moving ribbon microphone, and more specifically, to a diaphragm of the microphone which is formed like a ribbon.

BACKGROUND ART

A moving ribbon microphone is a velocity microphone in which a ribbon-like diaphragm (ribbon foil) having backplates attached to its opposite ends is placed in a magnetic gap provided by a pair of permanent magnets. Before the advent of a moving coil microphone, Siemens & Halska in Germany developed the first moving ribbon microphone in about 1933 (see Non-Patent Document 1; "50 Years of Audio History" issued by Japan Audio Society on Dec. 4, 1986 (pp. 180 to 187).

In the moving ribbon microphone (simply referred to as a ribbon microphone), the diaphragm is generally composed of an aluminum foil. This is because aluminum is more suitable for the ribbon microphone than other metals in terms of conductivity and specific gravity.

Further, in order to reduce the resonance frequency of the diaphragm, conventional techniques use a molding apparatus such as a gear to fold the ribbon foil into a folding screen form (zigzag form). Also in this respect, aluminum, which is ductile, is suitable.

On the other hand, aluminum offers a very low conductor resistance (0.1 to 0.2 Ω). Accordingly, a diaphragm made of an aluminum foil provides a low signal level. Thus, in a ribbon microphone having a diaphragm consisting of an aluminum foil, generally, the diaphragm is connected to a primary side of a booster transformer to obtain a high signal level from a secondary side (see Non-Patent Document 2; JOURNAL OF THE AUDIO ENGINEERING SOCIETY (Vol. 1 to 27) p. 204).

As described above, the aluminum used in the diaphragm is preferably a pure aluminum material, which contains no other metals, in connection with ductility. However, the pure aluminum material is prone to couple to moisture in air to form an aluminum hydroxide film on its surface. The pure aluminum material thus offers only a low corrosion resistance and is disadvantageously susceptible to secular variations.

Further, a backplate supporting the diaphragm is generally composed of a copper alloy such as brass which is very conductive. However, this results in a bimetallic junction with aluminum, which may lead to electrolytic corrosion. That is, since the diaphragm is connected to the primary side of the booster transformer via the backplate, when this part has an increased resistance value, problems may occur such as the occurrence of noise, a decrease in sensitivity, and a rise in impedance.

SUMMARY OF THE INVENTION

It is thus an object of the present invention to provide a moving ribbon microphone comprising a diaphragm made of an aluminum foil, in which the aluminum foil offers a corrosion resistance and in which a favorable electrically connected state can be maintained in the junction between the aluminum foil and backplates for a long time.

To accomplish this object, the present invention provides a moving ribbon microphone comprising a diaphragm made of an aluminum foil whose opposite ends are supported by backplates, the diaphragm being placed in a magnetic gap, the microphone being characterized in that a gold deposited film is formed on opposite surfaces of the diaphragm.

In this configuration, since the surface of the diaphragm, consisting of the aluminum foil, is covered with the gold deposited film, it is possible to improve corrosion resistance to suppress secular variations. Further, the metal deposited film has a high ductility and thus does not affect folding of the diaphragm.

In a more preferable aspect, the gold deposited film has a thickness of at least 500 Angstrom and 10% or less of the mass of the gold deposited film is added to the diaphragm. This makes it possible to reliably prevent oxidation of the aluminum foil. It is also possible to limit a variation in sensitivity compared to the case in which the gold deposited film is not formed, to at most 1 dB.

In another aspect, a gold deposited film is preferably also formed on the surfaces of each backplate which contacts with the diaphragm. Thus, when the diaphragm and the backplates are connected together, the gold deposited films are joined together. This prevents electrolytic corrosion caused by a bimetallic junction to maintain a favorable electric connected state with a stable resistance value for a long time. It is therefore possible to prevent the occurrence of noise, a decrease in sensitivity, and a rise in output impedance which may result from an inappropriate connection (increased resistance value).

DETAILED DESCRIPTION

Figure 1:
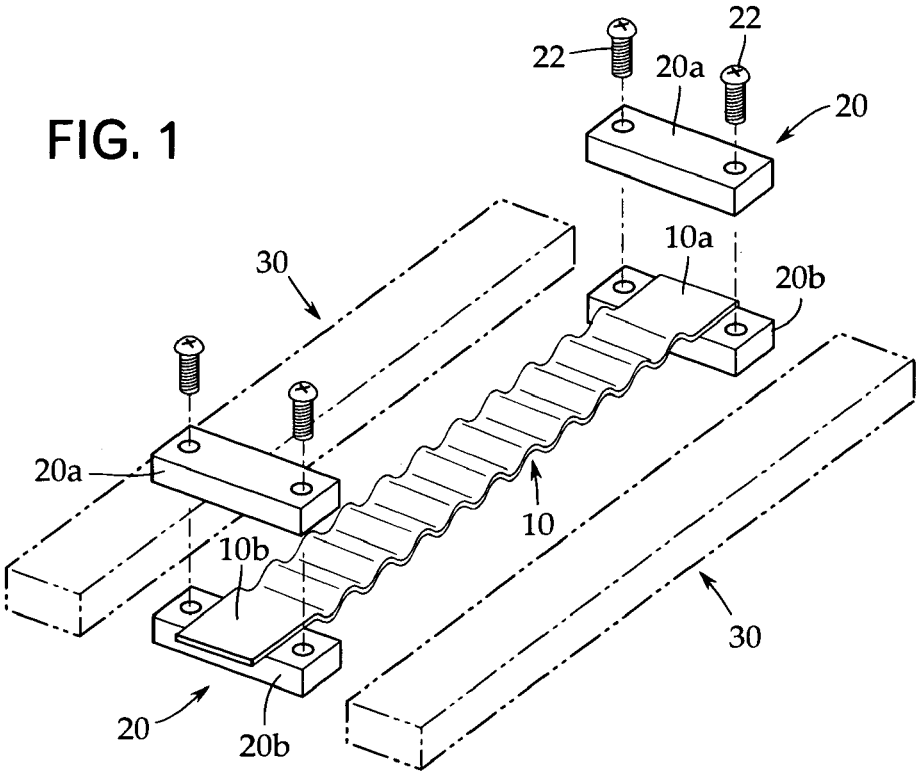
FIG. 1 is a schematic exploded perspective view showing a moving ribbon microphone.
Figure 2:
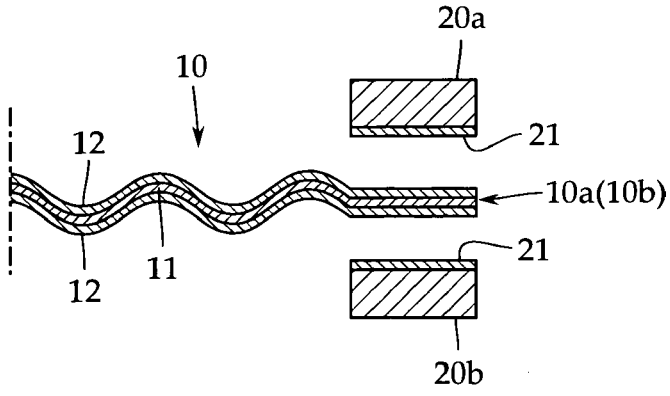
FIG. 2 is an enlarged sectional view showing an essential part of the present invention.

Now, an embodiment of the present invention will be described with reference to FIGS. 1 and 2. However, the present invention is not limited to this. FIG. 1 is a schematic exploded perspective view showing a moving ribbon microphone. FIG. 2 is an enlarged sectional view showing an essential part of the present invention.

As shown in FIG. 1, the moving ribbon microphone comprises a diaphragm 10 formed like a ribbon (an elongate band). The diaphragm 10 is folded into a zigzag form except for its opposite ends 10*a* and 10*b* in order to reduce resonance frequency. The folding operation can be performed by passing the diaphragm 10 through a molding apparatus having, for example, a pair of gears.

As shown in the enlarged view in FIG. 2, the diaphragm 10 is composed of an aluminum foil 11 because of its high conductivity, small specific gravity, and ductility that facilitates the folding operation. The aluminum foil 11 is preferably a pure aluminum material, which does not contain any other metals.

Backplates 20, 20 are attached to the opposite ends 10*a* and 10*b* of the diaphragm 10. The diaphragm 10 is placed in the magnetic gap between a pair of permanent magnets 30 and 30 shown by imaginary lines in FIG. 1 while fixed to the backplates 20, 20. The diagram 10 is supported in a microphone housing (not shown) so that it can be vibrated.

Each of the backplates 20, 20 comprises a pair of electrode plates 20*a* and 20*b*, which sandwiches a corresponding end of the diaphragm 10 between the electrode plates 20*a* and 20*b*. In this example, the electrode plates 20*a* and 20*b* consist of a copper alloy, which is very conductive and which can be easily and appropriately machined. However, other metals may be used. Screws 22 may be used as tightening means for tightening the electrode plates 20*a* and 20*b*.

According to the present invention, a gold deposited film 12 is formed on the opposite surfaces of the aluminum foil 11 including the opposite ends 10*a* and 10*b*, the aluminum foil 11 constituting the diaphragm 10. Preferably, the gold deposited film 12 has a thickness of at least 500 Angstrom (50 nm) and 10% or less of the mass of the gold deposited film 12 is added to the diaphragm 10.

By setting the thickness and mass of the gold deposited film 12 within the above ranges, it is possible to reliably prevent oxidation of the aluminum foil and to limit a variation in sensitivity compared to the case in which the gold deposited film is not formed, to at most 1 dB. Further, the gold deposited film 12 is also very ductile. Accordingly, the diaphragm 10 can be easily folded.

Furthermore, in order to prevent electrolytic corrosion resulting from a bimetallic junction, it is preferable to form a metal deposited film 21 on inner surfaces (the surfaces between which the diaphragm 10 is sandwiched) of the electrode plates 20*a* and 20*b*. It is also possible to use a printed circuit board in which one or both of the electrode plates 20*a* and 20*b* are plated with gold.

When the microphone is assembled, the backplates 20, 20 are attached to the opposite ends 10*a* and 10*b* of the diaphragm 10. The diaphragm 10 is connected to the primary side of a booster transformer (not shown) via the backplates 20, 20. However, since the diaphragm 10 is coated with the gold deposited film 12, it offers a high corrosion resistance. Consequently, the diaphragm 10 is subject to few secular variations.

Further, by forming the gold deposited film 21 on the inner surfaces of the electrode plates 20*a* and 20*b* of each backplate 20, it is possible to reliably make an electric connection with the primary side of the booster transformer. This makes it possible to prevent the occurrence of noise, a decrease in sensitivity, and a rise in impedance which may result from an inappropriate contact.

The invention claimed is:

1. A moving ribbon microphone comprising:

a diaphragm formed of a ribbon-shaped aluminum foil and having opposite ends, the diaphragm being placed in a magnetic gap, backplates for holding the opposite ends, and gold deposited films formed on entire opposing surfaces of the diaphragm to prevent corrosion of the diaphragm including portions sandwiched by the backplates, wherein a gold deposited film is also formed on surfaces of each backplate which contacts with the diaphragm.

* * * * *